US008591250B2

(12) United States Patent
Chin et al.

(10) Patent No.: US 8,591,250 B2
(45) Date of Patent: Nov. 26, 2013

(54) ELECTRICAL PLUG CONNECTOR, ELECTRICAL SOCKET CONNECTOR, ELECTRICAL PLUG AND SOCKET CONNECTOR ASSEMBLY

(75) Inventors: Hsien-Ning Chin, Taoyuan County (TW); Kun-Shen Wu, Taoyuan County (TW)

(73) Assignee: Aces Electronics Co., Ltd., Taoyuan County (TW)

( * ) Notice: Subject to any disclaimer, the term of this patent is extended or adjusted under 35 U.S.C. 154(b) by 0 days.

(21) Appl. No.: 13/529,719

(22) Filed: Jun. 21, 2012

(65) Prior Publication Data

US 2013/0052879 A1 Feb. 28, 2013

(30) Foreign Application Priority Data

Aug. 26, 2011 (TW) ..... 100216035 U

(51) Int. Cl.
*H01R 13/00* (2006.01)

(52) U.S. Cl.
USPC ..... 439/485; 439/947

(58) Field of Classification Search
USPC ..... 439/682, 78, 79, 660, 507, 825, 907, 439/947, 485, 487
See application file for complete search history.

(56) References Cited

U.S. PATENT DOCUMENTS

| | | | | |
|---|---|---|---|---|
| 4,050,045 | A * | 9/1977 | Motten et al. | 337/187 |
| 4,494,814 | A * | 1/1985 | Oyama | 439/485 |
| 5,158,471 | A * | 10/1992 | Fedder et al. | 439/80 |
| 5,170,067 | A * | 12/1992 | Baum et al. | 307/10.1 |
| 6,203,335 | B1 * | 3/2001 | Chang | 439/79 |
| 6,299,492 | B1 * | 10/2001 | Pierini et al. | 439/884 |
| 6,471,523 | B1 * | 10/2002 | Shuey | 439/63 |
| 6,780,027 | B2 * | 8/2004 | Allison | 439/79 |
| 6,832,931 | B1 * | 12/2004 | Wu | 439/499 |
| 6,848,950 | B2 * | 2/2005 | Allison et al. | 439/682 |
| 7,001,189 | B1 * | 2/2006 | McGowan et al. | 439/79 |
| 7,597,573 | B2 * | 10/2009 | Defibaugh et al. | 439/206 |
| 2008/0096399 | A1 * | 4/2008 | Goh | 439/55 |

* cited by examiner

*Primary Examiner* — Tulsidas Patel
*Assistant Examiner* — Phuongchi T Nguyen
(74) *Attorney, Agent, or Firm* — Muncy, Geissler, Olds & Lowe, PLLC

(57) ABSTRACT

In an electrical plug and socket connector assembly, each conducting terminal of each of the electrical plug connector and electrical socket connector defines two side panels spaced by a gap, two contact end portions respectively forwardly extended from the two side panels, bonding pegs downwardly extended from the bottom edges of the side panels, and radiation fins respectively extended from the topmost edges of the side panels and suspending above the gap. Subject to the design of the gap and radiation fins, waste heat created during operation of the electrical plug and socket connectors can be quick dissipated into the atmosphere, lowering the temperature and smoothing conduction of power supply.

6 Claims, 11 Drawing Sheets

ELECTRICAL PLUG CONNECTOR, ELECTRICAL SOCKET CONNECTOR, ELECTRICAL PLUG AND SOCKET CONNECTOR ASSEMBLY

This application claims the priority benefit of Taiwan patent application number 100216035, filed on Aug. 26, 2011.

BACKGROUND OF THE INVENTION

1. Field of the Invention

The present invention relates to electrical connector technology and more particularly, to an electrical plug and socket connector assembly, which effectively lowers conducting terminal contact impedance and temperature, smoothing conduction of power supply and assuring a high level of safety.

2. Description of the Related Art

When designing an electrical connector for joining electrical circuits, a designer will pay attention to the two basic parts, i.e., signal and power supply. When designing a signal circuit, a designer normally will not consider the factor of current variation for the reason that the applied current is normally low. However, with respect to the transmission of signals, a designer usually will consider the nature of the carrier (high frequency, low frequency) and many other factors (static interference, magnetic interference, impedance matching, etc.) without taking the factor of temperature into account. With respect to power supply, conducting a high-current power supply through a power circuit will increase the impedance, causing a rise in temperature. Thus, when designing an electrical power connector for joining power circuits, the factors of quick heat dissipation and low conducting terminal impedance must be considered, avoiding a significant change in the electrical characteristics. Therefore, the dimensions of contact surface area and heat dissipation surface area affect the power transmission quality of the conducting terminals of electrical plug and socket connectors. Electrical plug and socket type power connectors are normally used in power supply equipments and server equipments. A small power loss of each power connector in a server equipment results in a large server room power loss.

Therefore, it is desirable to provide an improved design of electrical plug and socket connector assembly, which eliminates the drawbacks of the aforesaid prior art design.

SUMMARY OF THE INVENTION

The present invention has been accomplished under the circumstances in view. It is therefore the main object of the present invention to provide an electrical plug and socket connector assembly, which effectively lowers conducting terminal contact impedance and temperature, smoothing conduction of power supply and assuring a high level of safety.

To achieve this and other objects of the present invention, an electrical plug and socket connector assembly comprises an electrical plug connector and an electrical socket connector. The electrical plug connector and the electrical socket connector each comprise an electrically insulative housing and a plurality of conducting terminals mounted in the electrically insulative housing. Each conducting terminal comprises two side panels spaced by a gap, bonding legs downwardly extended from the bottom edges of the side panels, a plurality of radiation fins respectively extended from the topmost edges of the side panels and suspending above the gap between the side panels, and two contact end portions respectively forwardly extended from the two side panels. Subject to the design of the gap and the radiation fins, waste heat created during operation of the electrical plug and socket connectors can be quickly dissipated into the atmosphere, lowering the impedance and temperature, smoothing conduction of power supply and assuring a high level of safety.

DETAILED DESCRIPTION OF THE PREFERRED EMBODIMENT

Figure 1:
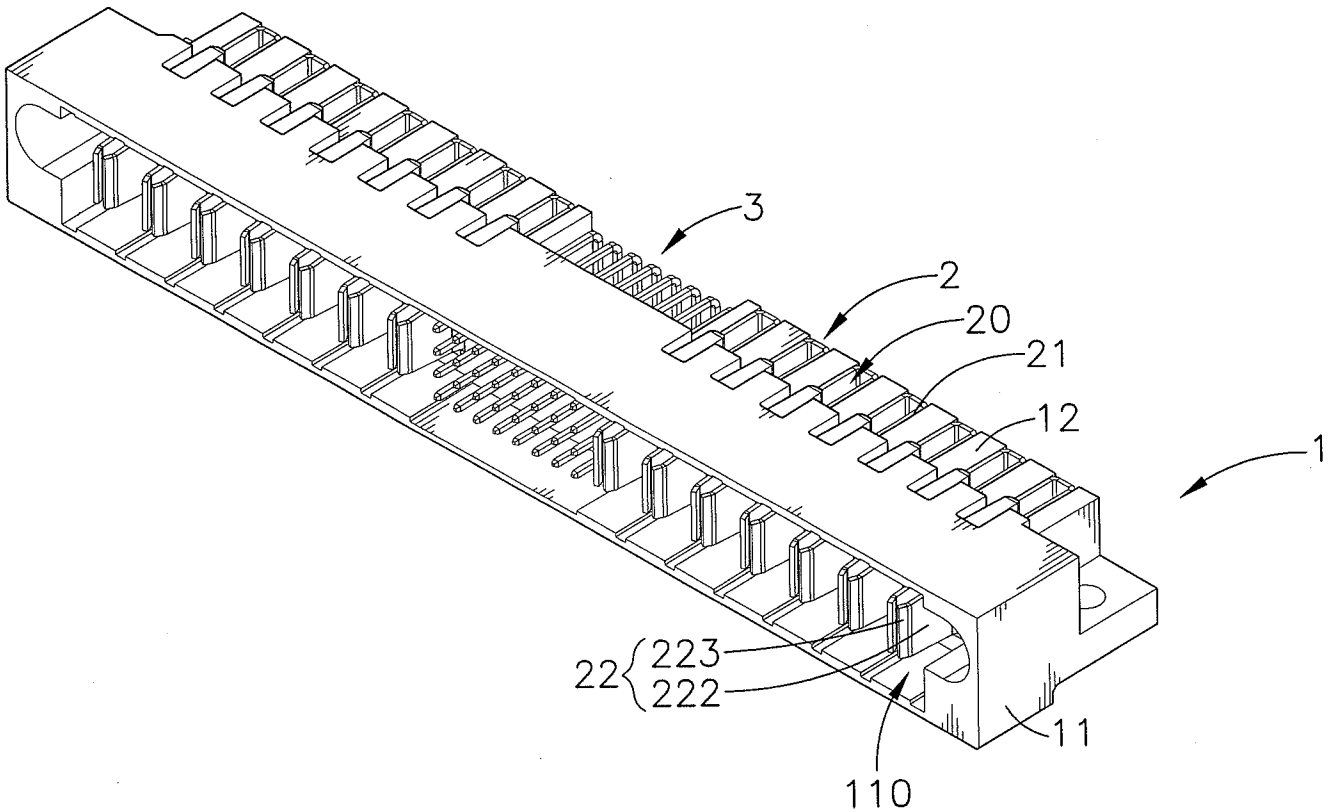
FIG. 1 is an elevational view of an electrical plug connector in accordance with the present invention.
Figure 2:
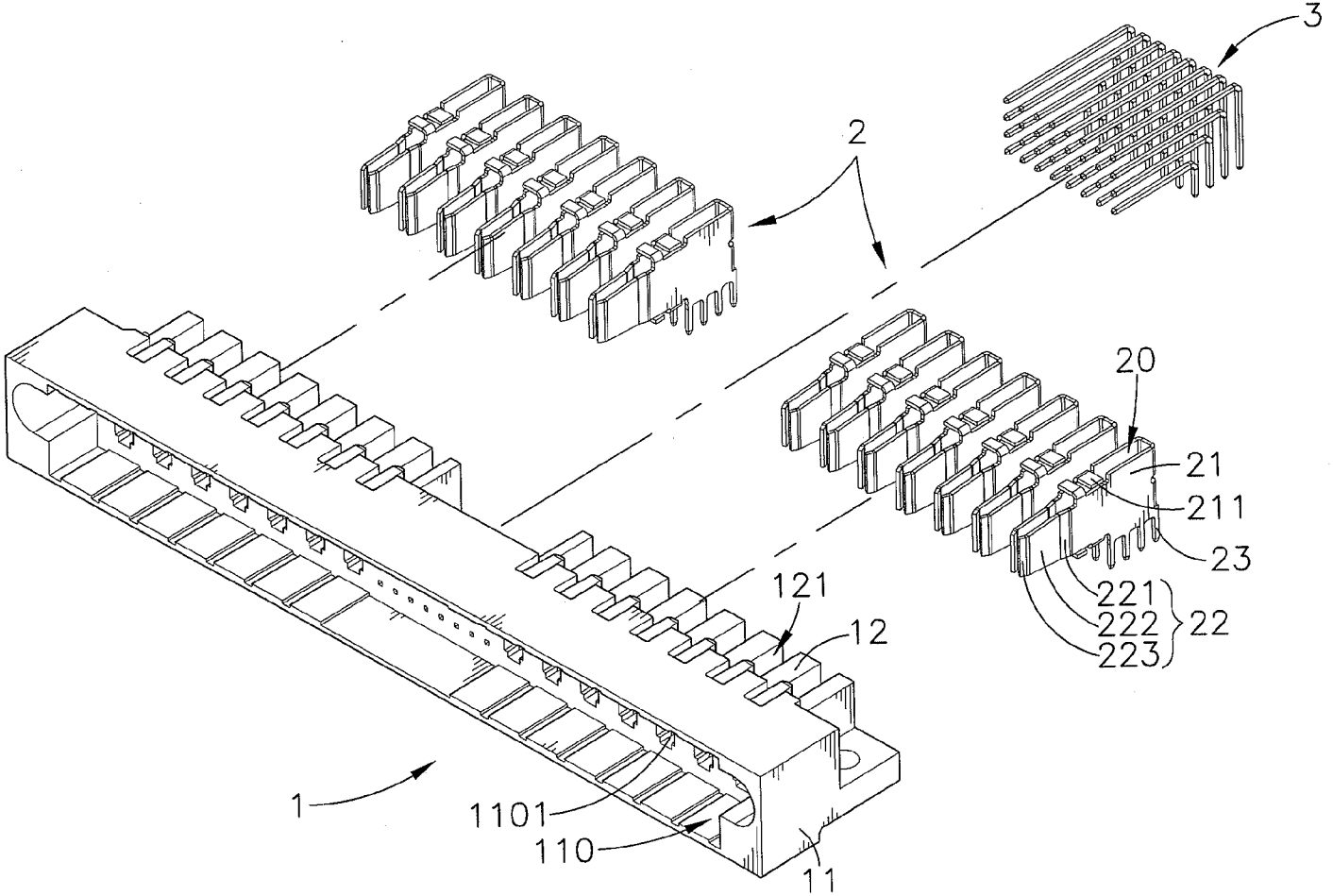
FIG. 2 is an exploded view of the electrical plug connector in accordance with the present invention.
Figure 3:
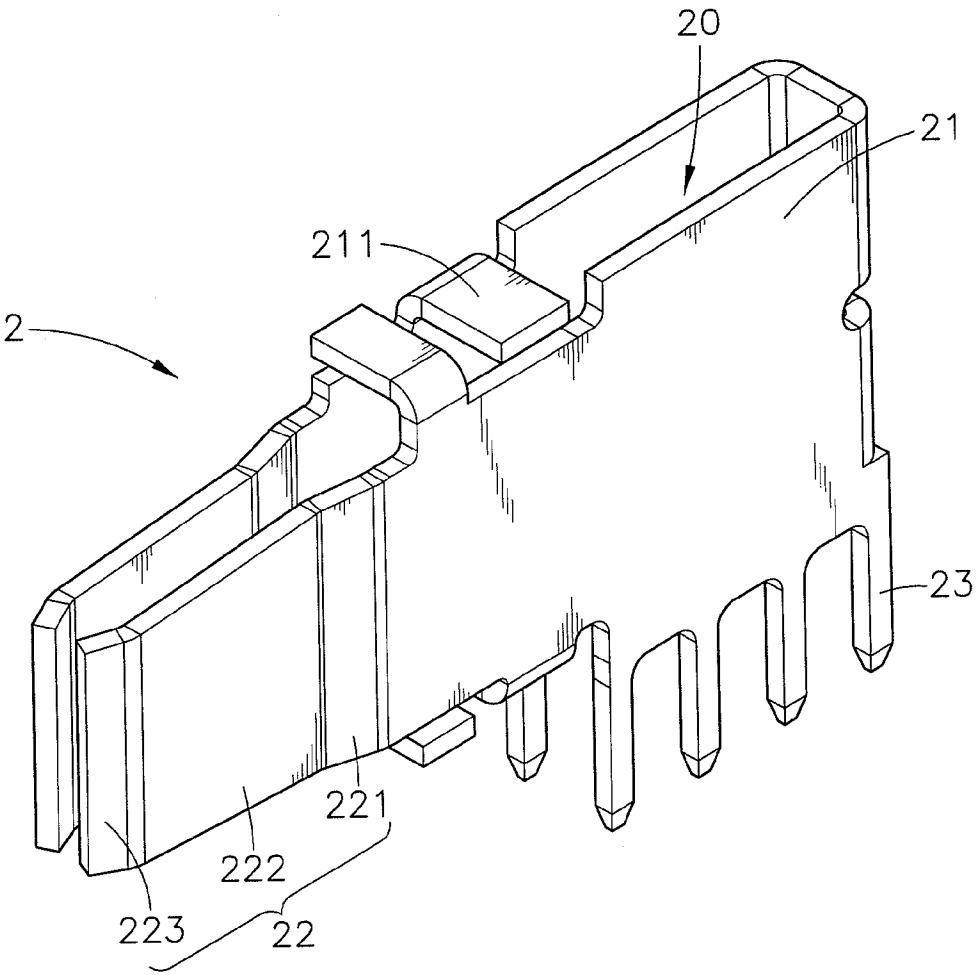
FIG. 3 is an elevational view of one conducting terminal used in the electrical plug connector in accordance with the present invention.
Figure 4:
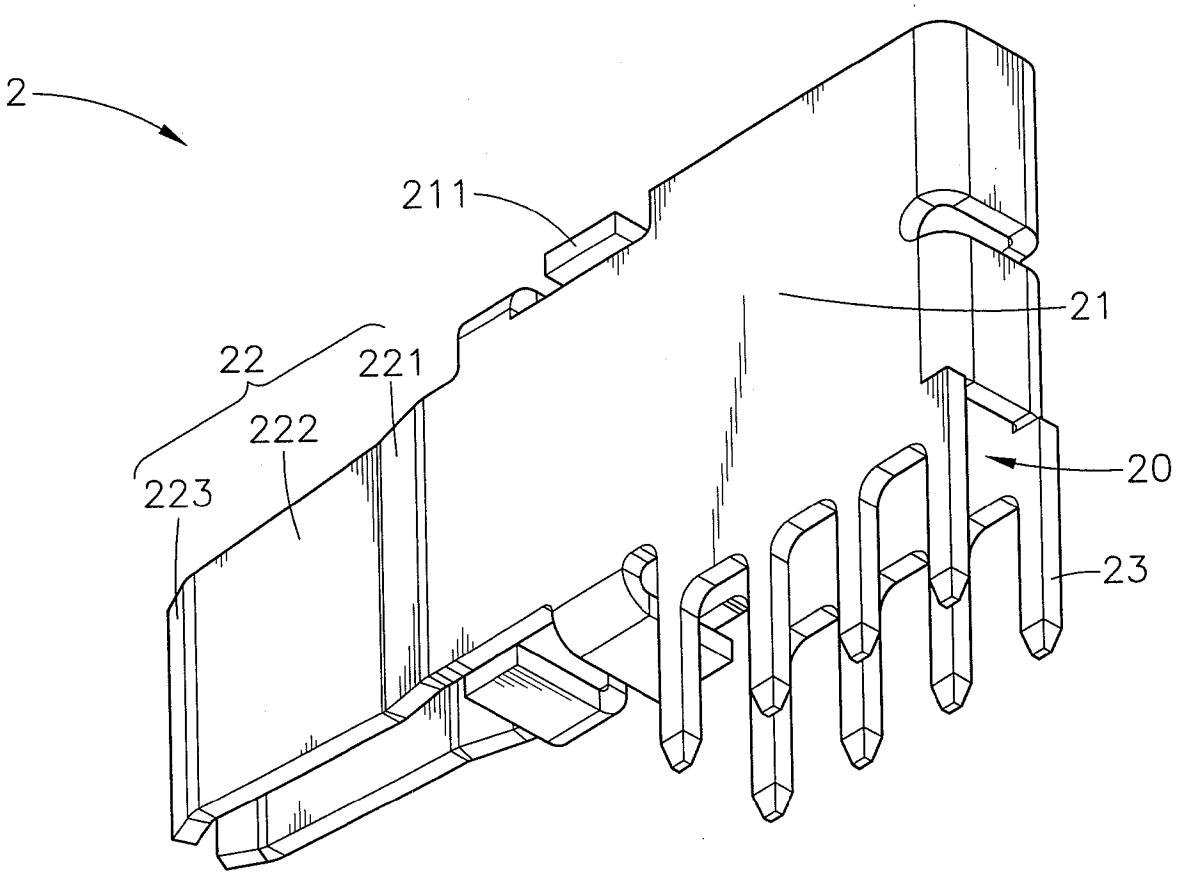
FIG. 4 corresponds to FIG. 3 when viewed from another angle.
Figure 5:
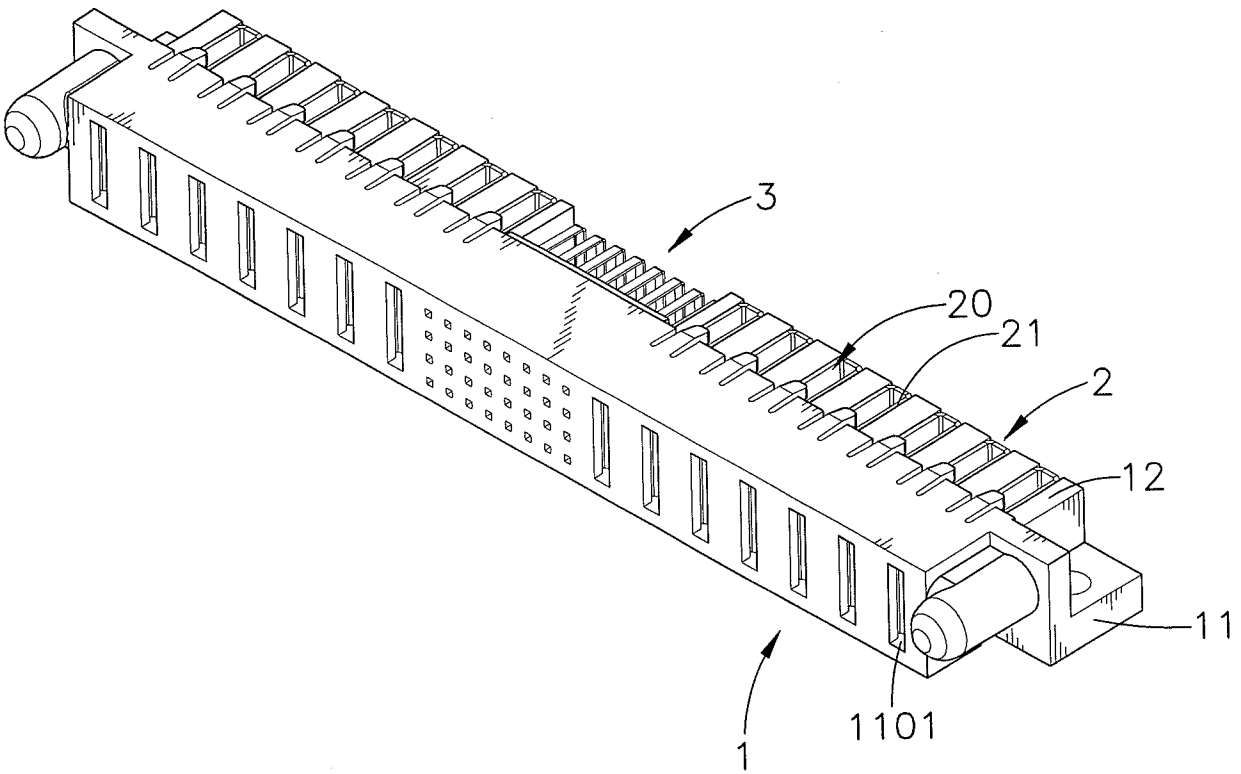
FIG. 5 is an elevational view of an electrical socket connector in accordance with the present invention.
Figure 6:
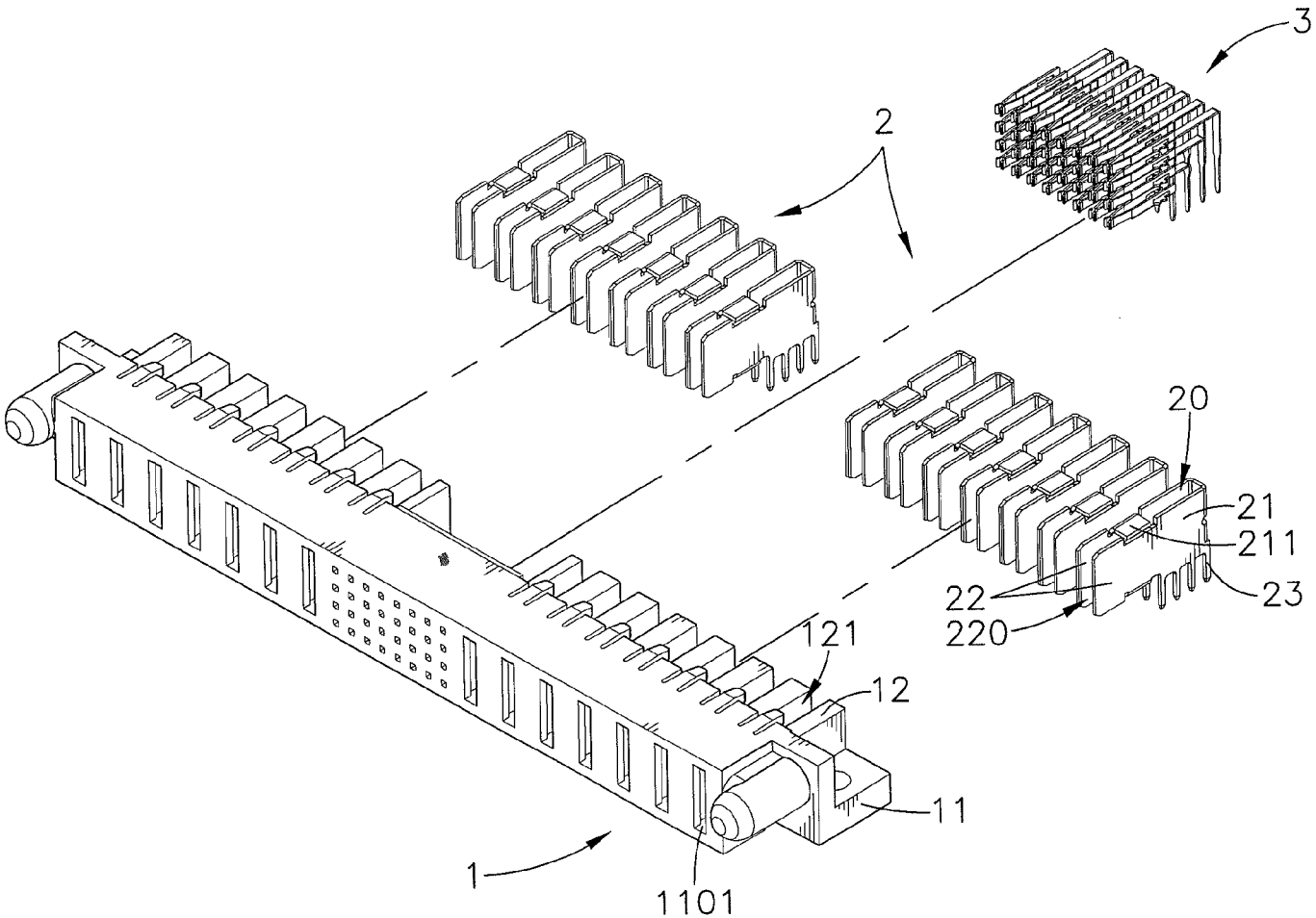
FIG. 6 is an exploded view of the electrical socket connector in accordance with the present invention.
Figure 7:
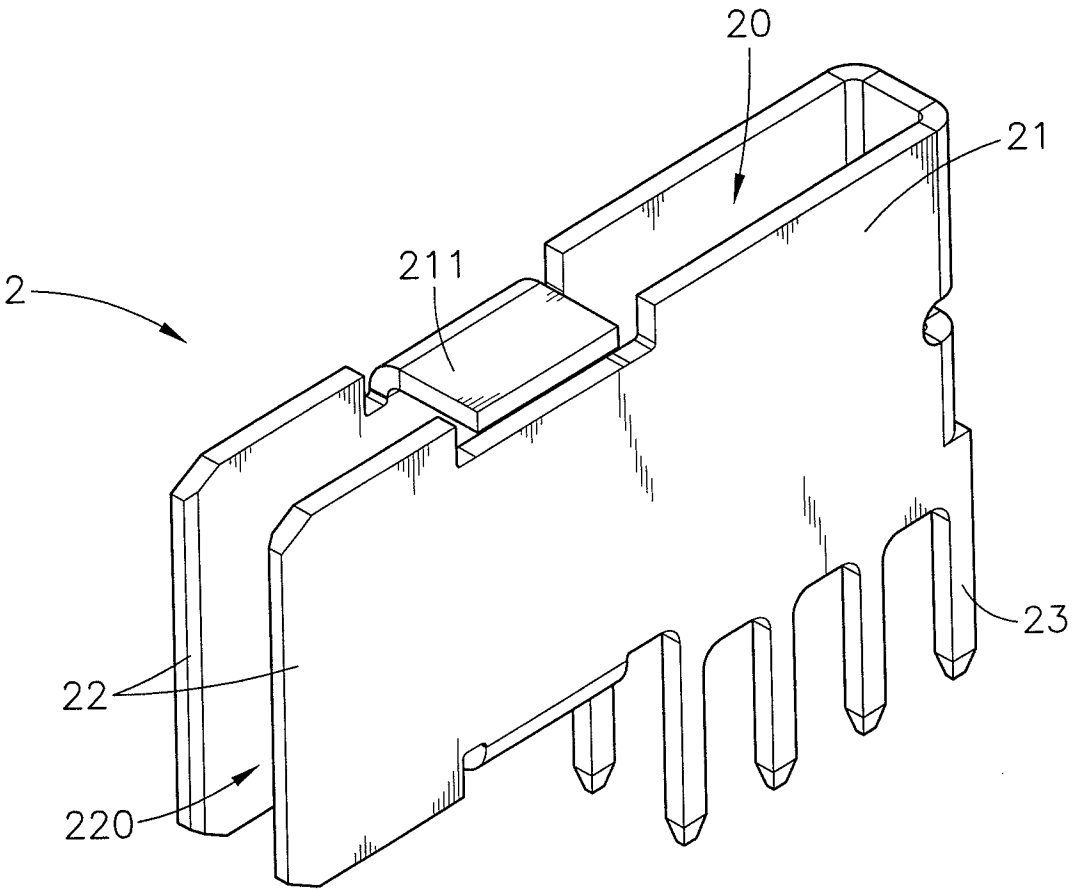
FIG. 7 is an elevational view of one conducting terminal used in the electrical socket connector in accordance with the present invention.
Figure 8:
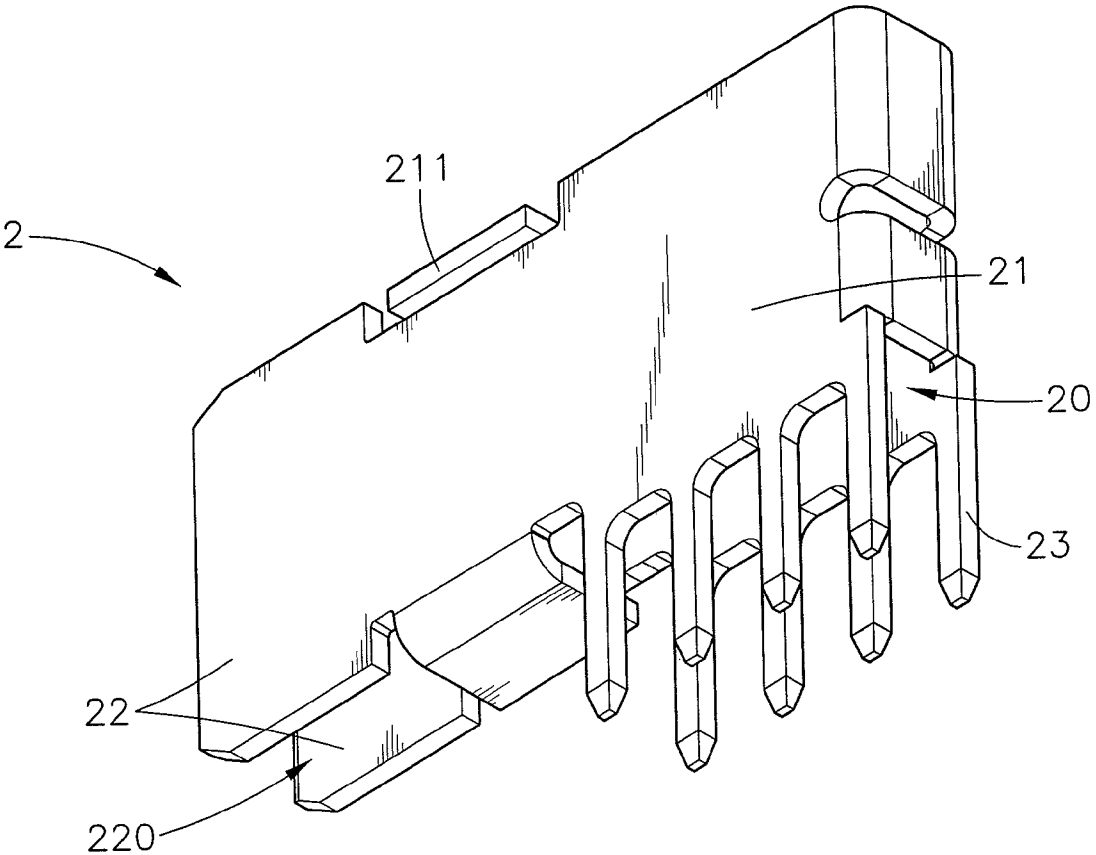
FIG. 8 corresponds to FIG. 7 when viewed from another angle.

Referring to FIGS. 1, 2, 3 and 4, an electrical plug connector in accordance with the present invention is shown comprising an electrically insulative housing 1, and a plurality of conducting terminals 2.

The electrically insulative housing 1 comprises a mating portion 11, a receiving chamber 110 defined in one side of the mating portion 11, a plurality of partition plates 12 arranged in two sets at an opposite side of the mating portion 11, a plurality of insertion slots 121 respectively defined between each two adjacent partition plates 12 of each of the two sets of partition plates 12, and a plurality of terminal holes 1101 formed in the mating portion 11 and respectively disposed in communication between the insertion slots 121 and the receiving chamber 110.

The conducting terminals 2 are respectively mounted in the insertion slots 121 of the electrically insulative housing 1. Each conducting terminal 2 comprises two side panels 21 arranged in a substantially parallel manner and defining therebetween a gap 20, a plurality of radiation fins 211 respectively extended from the topmost edges of the two side panels 21 and suspending above the gap 20 for quick dissipation of waste heat from the side panels 21 into the atmosphere, two contact end portions 22 respectively forwardly extended from the two side panels 21 and engaged into one respective terminal hole 1101, and a plurality of bonding pegs 23 respectively downwardly extended from respective bottom edges of the side panels 21. Further, each contact end portion 22 defines a rear inflection surface 221 obliquely inwardly extended from the associating side panel 21, a middle planar surface 222 forwardly extended from the rear inflection surface 221, and an inwardly inclined front guide surface 223 inwardly extended from a front side of the middle planar surface 222 opposite the rear inflection surface 221.

Referring to FIGS. 5, 6, 7 and 8, an electrical socket connector in accordance with the present invention is shown comprising an electrically insulative housing 1, and a plurality of conducting terminals 2.

The electrically insulative housing 1 comprises a mating portion 11, a plurality of partition plates 12 arranged in two sets at a rear side of the mating portion 11, a plurality of insertion slots 121 respectively defined between each two adjacent partition plates 12 of each of the two sets of partition plates 12, and a plurality of terminal holes 1101 formed in a front side of the mating portion 11 and respectively disposed in communication with the insertion slots 121.

The conducting terminals 2 are respectively mounted in the insertion slots 121 of the electrically insulative housing 1. Each conducting terminal 2 comprises two side panels 21 arranged in a substantially parallel manner and defining therebetween a gap 20, two contact end portions 22 respectively forwardly extended from the two side panels 21 and inserted into one respective terminal hole 1101, a receiving space 220 defined between the two contact end portions 22 in communication with the gap 20 for receiving one respective conducting terminal of a mating electrical plug connector, at least one radiation fin 211 extended from the topmost edge of at least one of the two side panels 21 and suspending above the gap 20 for quick dissipation of waste heat from the side panels 21 into the atmosphere, and a plurality of bonding pegs 23 respectively downwardly extended from respective bottom edges of the side panels 21.

Referring to FIGS. 1, 2, 5 and 6 again, the contact end portions 22 of the conducting terminals 2 of the electrical plug connector and electrical socket connector are respectively inserted into the insertion slots 121 of the respective electrically insulative housing 1.

Referring to FIGS. 2, 3, 6 and 7, when a high heat is developed upon conduction of a high-current power supply through the conducting terminals 2 after connection of the electrical plug connector and the electrical socket connector, developed heat can be quickly dissipated through the respective gaps 20 in the insertion slots 121 into the atmosphere. Further, subject to the operation of an electric fan to create a cooling current of air through the connected electrical plug connector and electrical socket connector, the conducting terminals 2 are maintained within a predetermined operating temperature range, avoiding a significant change in the electrical characteristics of the conducting terminals 2.

Figure 9:
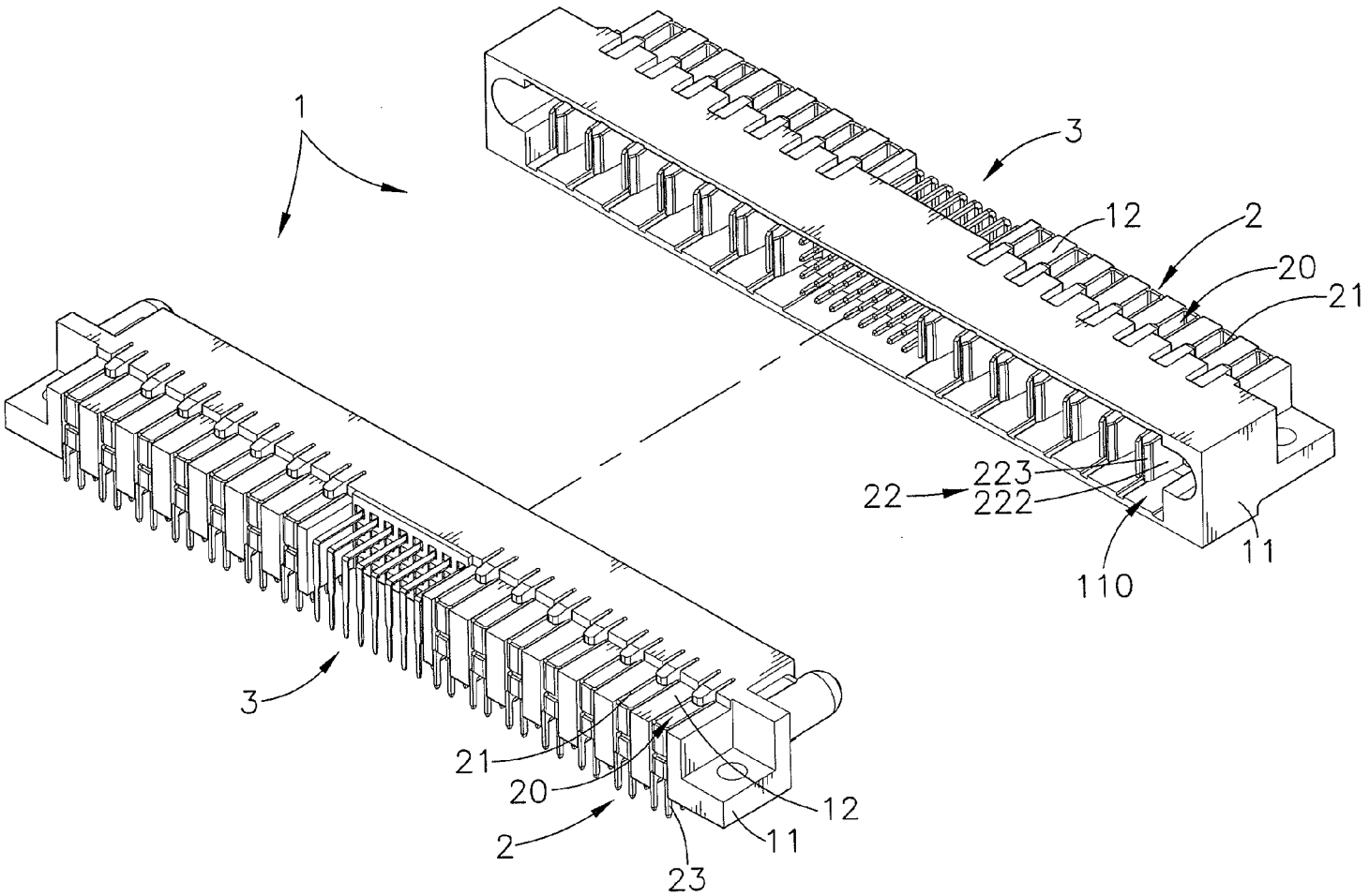
FIG. 9 is an exploded view of an electrical plug connector and an electrical socket connector of an electrical plug and socket connector assembly in accordance with the present invention.
Figure 10:
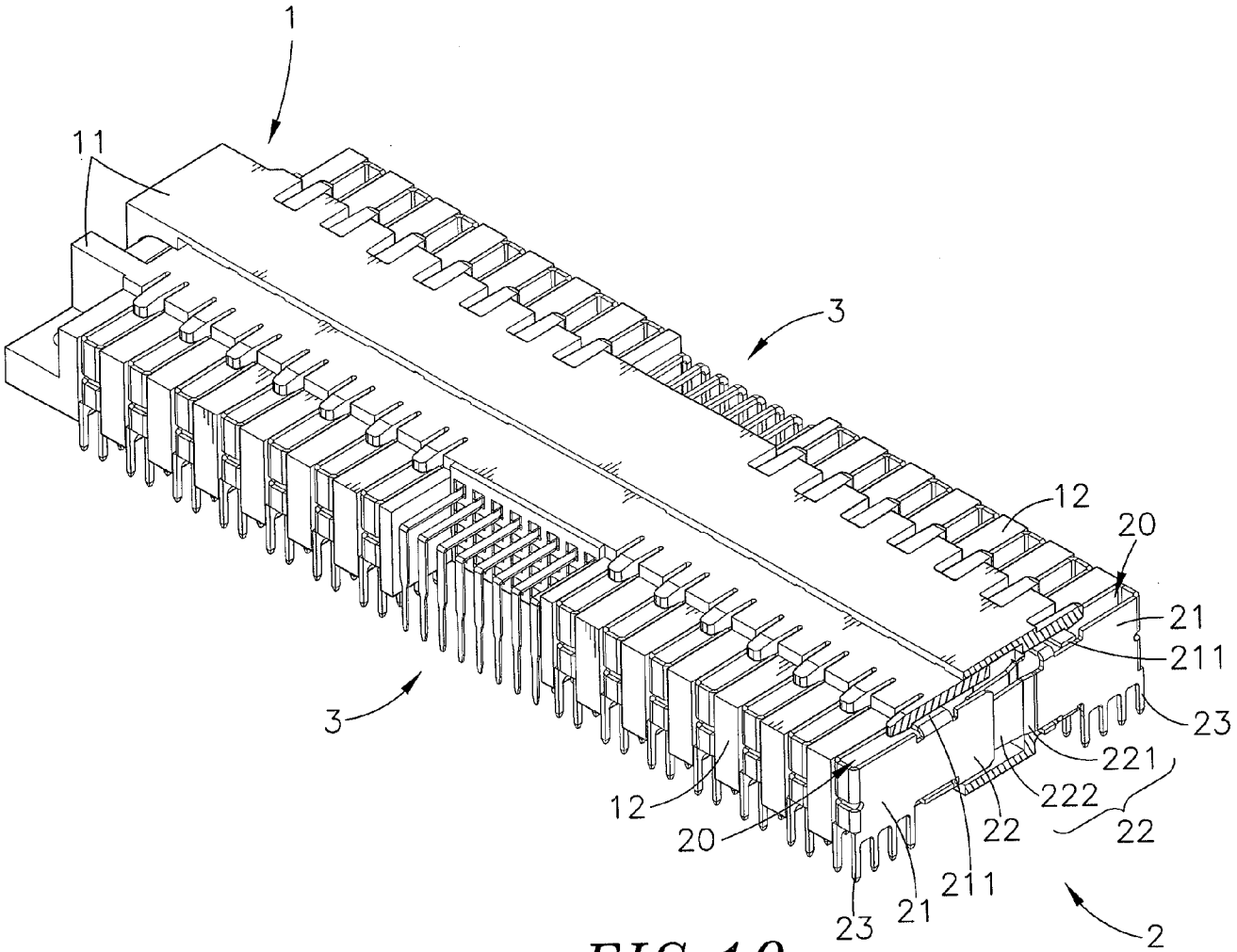
FIG. 10 is an assembly view of the electrical plug and socket connector assembly in accordance with the present invention.

Referring to FIGS. 9 and 10, when a high-current power supply is transmitting through the conducting terminals 2 of the electrical plug connector and electrical socket connector, the large contact area between the side panels 21 of each conducting terminal 2 of the electrical plug connector and the side panels 21 of the mating conducting terminal 2 of the electrical socket connector smoothing power conduction, thereby reducing the impedance.

The aforesaid electrical plug connector and electrical socket connector each further comprise a plurality of signal terminals 3 for transmitting data signals. As the signal terminals 3 are not within the spirit and scope of the invention, not further detailed description will be provided.

Figure 11:
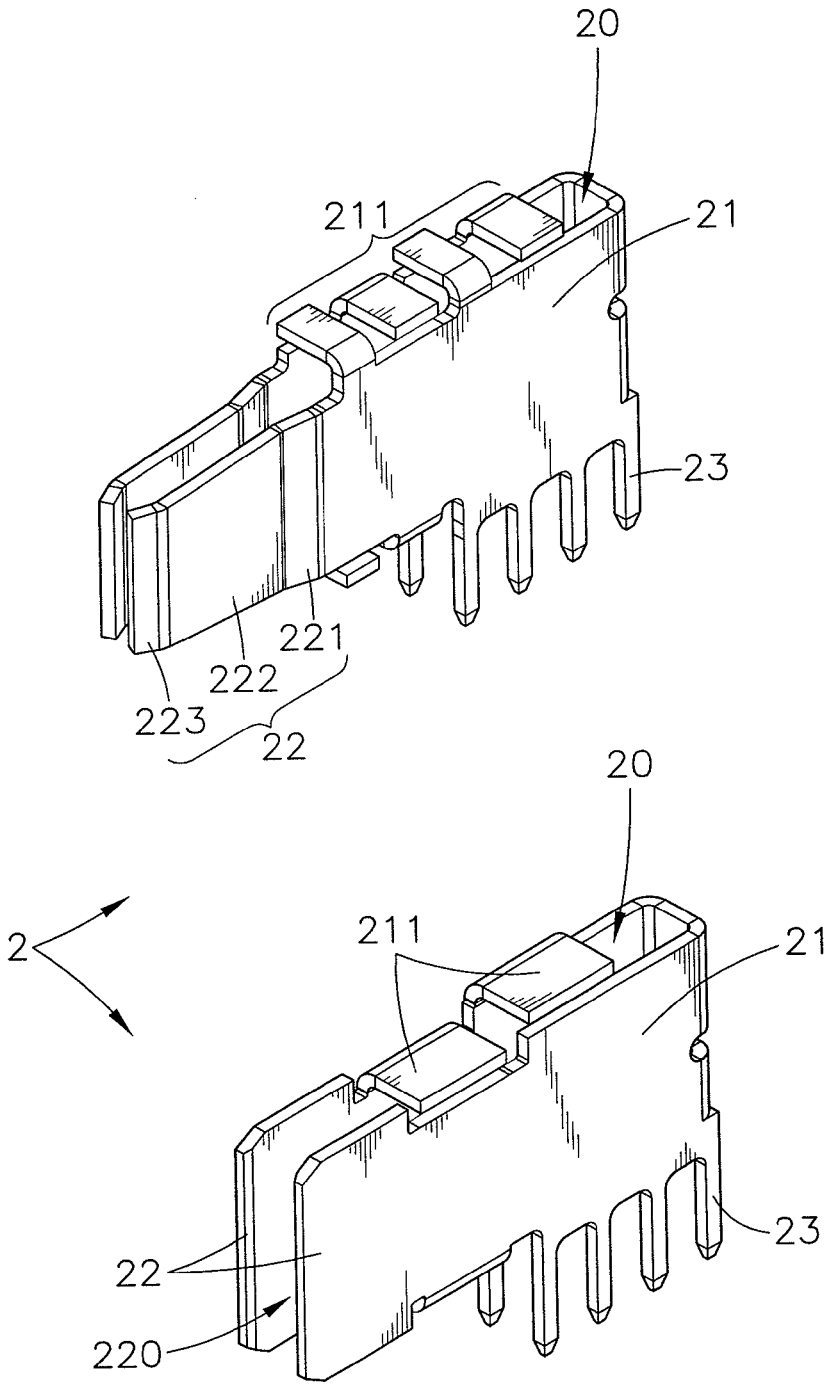
FIG. 11 is an elevational view of an alternate form of the conducting terminal for electrical plug connector and an alternate form of the conducting terminal for electrical socket connector in accordance with the present invention.

Referring to FIG. 11, the main feature of the conducting terminals 2 is the design of the radiation fins 211 that are respectively extended from the topmost edges of the side panels 21 and suspending above the gap 20 for quick dissipation of waste heat from the side panels 21 into the atmosphere. Subject to the design of radiation fins 211, waste heat created during operation of the electrical plug and socket connectors can be quickly dissipated into the atmosphere, lowering the temperature.

Further, the contact end portions 22 of the conducting terminals 2 of the electrical plug connector and electrical socket connector can be positioned in the insertion slots 121 of the respective electrically insulative housing 1 by means of snap-in engagement, friction engagement, interference-fit engagement, or any other engagement designs.

Further, the number of the radiation fins 211 of the conducting terminals 2 can be increased to fit different requirements.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical plug connector, comprising:

an electrically insulative housing comprising a mating portion, a receiving chamber defined in one side of said mating portion, a plurality of partition plates arranged in two sets at an opposite side of said mating portion, a plurality of insertion slots respectively defined between each two adjacent said partition plates of each of said two sets of partition plates, and a plurality of terminal holes formed in said mating portion and respectively disposed in communication between said insertion slots and said receiving chamber; and a plurality of conducting terminals respectively mounted in said insertion slots of said electrically insulative housing, each said conducting terminal comprising two side panels arranged in a substantially parallel manner and defining therebetween a gap, two contact end portions respectively forwardly extended from said two side panels and engaged into one respective terminal hole, a plurality of radiation fins respectively extended from respective topmost edges of said side panels and suspending above said gap, and a plurality of bonding pegs respectively downwardly extended from respective bottom edges of said side panels;

wherein said radiation fins are extended from the two opposite topmost edges of said side panels towards each other and arranged alternatively.

2. The electrical plug connector as claimed in claim 1, wherein each contact end portion of each said conducting terminal defines a rear inflection surface obliquely inwardly extended from the associating said side panel, a middle planar surface forwardly extended from said rear inflection surface, and an inwardly inclined front guide surface inwardly extended from a front side of said middle planar surface opposite to said rear inflection surface.

3. An electrical socket connector, comprising:

an electrically insulative housing comprising a mating portion, a plurality of partition plates arranged in two sets at a rear side of said mating portion, a plurality of insertion slots respectively defined between each two adjacent said partition plates of each of said two sets of partition plates, and a plurality of terminal holes formed in a front side of said mating portion and respectively disposed in communication with said insertion slots; and a plurality of conducting terminals respectively mounted in said insertion slots of said electrically insulative housing, each said conducting terminal comprising two side panels arranged in a substantially parallel manner and defining therebetween a gap, two contact end portions respectively forwardly extended from said two side panels and inserted into one respective said terminal hole, a receiving space defined between said two contact end portions in communication with said gap between said two side panels for receiving one respective conducting terminal of a mating electrical plug connector, a plurality of radiation fins respectively extended from respective topmost edges of said side panels and suspending above said gap, and a plurality of bonding pegs respectively downwardly extended from respective bottom edges of said side panels;

wherein said radiation fins are extended from the two opposite topmost edges of said side panels towards each other and arranged alternatively.

4. An electrical plug and socket connector assembly, comprising an electrical plug connector and an electrical socket connector, wherein:

said electrical plug connector comprises:

an electrically insulative housing comprising a mating portion, a receiving chamber defined in one side of the mating portion, a plurality of partition plates arranged in two sets at an opposite side of the mating portion, a plurality of insertion slots respectively defined between each two adjacent partition plates of each of the two sets of partition plates, and a plurality of terminal holes formed in the mating portion and respectively disposed in communication between the insertion slots and the receiving chamber; and a plurality of conducting terminals respectively mounted in the insertion slots of the electrically insulative housing of said electrical plug connector, each conducting terminal of electrical plug connector comprising two side panels arranged in a substantially parallel manner and defining therebetween a gap, two contact end portions respectively forwardly extended from the two side panels and engaged into one respective terminal hole of the electrically insulative housing of the electrical plug connector, a plurality of radiation fins respectively extended from respective topmost edges of the side panels and suspending above the gap between the two side panels, and a plurality of bonding pegs respectively downwardly extended from respective bottom edges of the side panels;

said electrical socket connector comprises:

an electrically insulative housing comprising a mating portion, a plurality of partition plates arranged in two sets at a rear side of the mating portion, a plurality of insertion slots respectively defined between each two adjacent partition plates of each of the two sets of partition plates, and a plurality of terminal holes formed in a front side of the mating portion and respectively disposed in communication with the insertion slots; and a plurality of conducting terminals respectively mounted in the insertion slots of the electrically insulative housing of said electrical socket connector, each conducting terminal of said electrical socket connector comprising two side panels arranged in a substantially parallel manner and defining therebetween a gap, two contact end portions respectively forwardly extended from the two side panels and inserted into one respective terminal hole of the electrically insulative housing of the electrical socket connector, a receiving space defined between the two contact end portions in communication with the gap between the two side panels for receiving one respective conducting terminal of a mating electrical plug connector, a plurality of radiation fins respectively extended from respective topmost edges of the side panels and suspending above the gap, and a plurality of bonding pegs respectively downwardly extended from respective bottom edges of the side panels;

wherein said radiation fins are extended from the two opposite topmost edges of said side panels towards each other and arranged alternatively.

5. The electrical plug and socket connector assembly as claimed in claim 4, wherein each contact end portion of each conducting terminal of said electrical plug connector defines a rear inflection surface obliquely inwardly extended from the associating side panel, a middle planar surface forwardly extended from said rear inflection surface, and an inwardly inclined front guide surface inwardly extended from a front side of said middle planar surface opposite to said rear inflection surface.

6. The electrical plug and socket connector assembly as claimed in claim 4, wherein the radiation fins of each conducting terminal of said electrical socket connector are alternatively extended from the topmost edges of the side panels of the respective conducting terminal.

* * * * *